United States Patent [19]

Noren

[11] Patent Number: 4,750,503

[45] Date of Patent: Jun. 14, 1988

[54] LATCH MECHANISM FOR FRONT-LOADING COMMERCIAL WAREWASHER

[75] Inventor: Tore H. Noren, Petaluma, Calif.

[73] Assignee: The Stero Company, Petaluma, Calif.

[21] Appl. No.: 876,639

[22] Filed: Jun. 20, 1986

[51] Int. Cl.[4] ..... B08B 13/00

[52] U.S. Cl. ..... 134/57 DL; 292/143; 292/147

[58] Field of Search ..... 134/57 DL; 100/56; 70/489; 292/183, 185, 186, DIG. 69, 138, 143, 147, 173, 150, 336.3

[56] References Cited

U.S. PATENT DOCUMENTS

| | | | |
|---|---|---|---|
| 3,099,471 | 7/1963 | Scott et al. | 292/DIG. 69 |
| 3,328,062 | 6/1967 | Geiger et al. | 292/DIG. 69 |
| 3,841,677 | 10/1974 | Guth | 292/DIG. 69 |

FOREIGN PATENT DOCUMENTS

| | | | |
|---|---|---|---|
| 2826712 | 12/1979 | Fed. Rep. of Germany | 292/DIG. 69 |
| 2838175 | 3/1980 | Fed. Rep. of Germany | 292/DIG. 69 |
| 2431944 | 1/1987 | Fed. Rep. of Germany | 292/DIG. 69 |

*Primary Examiner*—Harvey C. Hornsby

*Assistant Examiner*—Frankie L. Stinson

*Attorney, Agent, or Firm*—Biebel, French & Nauman

[57] ABSTRACT

A latch for a warewasher effects manual movement of a bolt between a retracted position which permits the door to be fully closed and an extended position which either latchingly engages a keeper to secure the door in the closed position, or abuttingly engages the keeper to prevent the door from being inadvertently fully closed. In addition to manual operation, the latch is operated by gravity to extend the bolt from its retracted to its extended position as the door of the warewasher is moved from a horizontal opened position to a vertical position. In this way, the bolt of the latch is extended to abut the keeper of a warewasher if the door is simply moved from the horizontal opened position to the vertical position, but may be easily and quickly closed by manual operation of the latch to retract the bolt followed by complete closure of the door, and then extension of the bolt to secure the door in the fully-closed position. Similarly, gravity operates the latch to retract the bolt from its extended to its retracted position as the door of the warewasher is moved from the vertical position to the horizontal opened position. The automatic retraction of the bolt as the door is moved to its horizontal opened position lessens the possibility of catching the bolt by means of apparel or other articles moved within the room housing the warewasher.

14 Claims, 2 Drawing Sheets

LATCH MECHANISM FOR FRONT-LOADING COMMERCIAL WAREWASHER

BACKGROUND OF THE INVENTION

The present invention relates generally to a warewasher for washing dishes, utensils, glasses and the like in commercial establishments, such as restaurants, particularly "fast food" restaurants and cafeterias, and more particularly, to an improved latch mechanism for a front-loading commercial warewasher.

The terms "warewasher" and "dishwasher" may be used interchangeably herein. Further, the term "commercial" dishwasher (to which this invention is directed), is intended to distinguish from a "domestic" dishwasher, the type commonly found in home use. Domestic and commercial dishwashers differ substantially in design and manner of use, even though a few commercial machine designs, which are an outgrowth of domestic designs, may have appearances similar to their domestic forerunners. These latter designs still differ in function and operation both in the length of time it takes to wash and rinse a rack of ware, and also in the number of washes and rinses per rack. These differences are dictated by the differing requirements for commercial machines as opposed to domestic machines. For example, it is rare in a domestic environment to wash consecutive racks or loads of ware; whereas, it is routine in the commercial environment, such as at a restaurant, where an operator may wash one rack of ware after another during and after a lunch period.

In addition to washing and rinsing, domestic machines ordinarily have the further capability of drying washed dishes within the wash chamber, whereas, commercial units utilize air drying outside the chamber in order to minimize the time it takes to complete each rack of ware. The drying operation within the wash chamber of a domestic machine requires a substantial portion of the 60–90 minutes required to complete an operating cycle for a single rack of ware in the domestic machine. By comparison, a commercial dishwasher will wash and rinse a rack of ware in 2–3 minutes or less, with the cleansed rack of ware being immediately removed and replaced by the next rack of soiled ware to be washed. Cleansed ware is then air dried in the racks outside the dishwasher. It is thus important in a commercial environment to wash racks of ware successively in rapid order, and accordingly, a commercial warewasher is used for washing and rinsing, but not for drying because of the length of time drying takes.

The kind of commercial dishwasher to which this invention is applicable is commonly referred to as a front-loading "stationary rack machine." Such a machine includes a wash chamber having a front opening which is closed by a pivotally-mounted door. A rack of soiled ware is deposited into the wash chamber, washed, rinsed and then removed and replaced by a second rack of soiled ware while the cleansed rack is air dried outside the chamber. For simplicity of operation and to facilitate rapid washing for consecutive racks or loads of ware in such a front-loading commercial warewasher, it is desirable to have complete closure of the machine door operate a switch signaling that a soiled rack of ware has been inserted into the machine and that a machine cycle is to be initiated. Accordingly, for a series of racks to be consecutively washed after a first rack, all that is required to operate the warewasher is that each washed rack be removed from the machine, a soiled rack of ware be inserted into the machine, and the door be completely closed. Such operation is described in U.S. patent application Ser. No. 833,946, filed Feb. 26, 1986, which is entitled "Low Energy, Low Water Consumption Warewasher and Method," is assigned to the same assignee as the present application and is incorporated herein by reference.

While door switch activation of the warewasher machine is advantageous to expedite operations during busy times, such operation can lead to wasted water and energy if the door is inadvertently fully closed while the wash chamber is empty. Under such circumstances, the warewasher proceeds through its normal operating cycle with the standard usage of electricity for operating the warewasher and hot water for rinsing the ware. In addition, in the warewasher of the referenced patent application, a booster heater may be provided to raise the temperature of incoming water to a sufficiently high sanitizing temperature, such as 180° F., and accordingly, booster heater energy may also be consumed. In accordance with the timing control mechanism of the referenced patent application, the booster heater is set to maintain the temperature of the water therein for a period of one hour, with the timer for the booster heater being reset each time the warewasher door is completely closed. Hence, if a booster heater is provided, not only would the electrical energy and hot water required for a single wash/rinse operating cycle be wasted, but the time during which the booster heater is activated would be extended by the inadvertent full or complete closure of the warewasher door.

To overcome these problems and ensure that the warewasher door is only fully closed after a rack of soiled ware has been placed into the wash chamber, a number of interlocking latch arrangements can be envisioned. For example, a spring-loaded bolt which would have to be retracted to allow complete closure of the door could be used to prevent one from moving the door to a vertical position out of the way, yet prevent the door from being fully closed unless full closure was intended. However, this as well as other apparent arrangements tend to be complicated and could interfere with the smooth and rapid operation of the warewasher during busy periods.

It is, therefore, apparent that a rugged, simple and inexpensive latch mechanism for a front-loading commercial warewasher is needed to positively prevent the inadvertent closure of the warewasher door while permitting its rapid and complete intentional closure.

SUMMARY OF THE INVENTION

In accordance with the present invention, an improved latch mechanism effects manual movement of a combination latching and abutting bolt between a retracted position which permits the door to be closed and an extended position which either latchingly engages a keeper to secure the door in the closed position or abuttingly engages the keeper to prevent the door from inadvertently being fully closed. In addition to the manual operation, the improved latch mechanism is operated by the force of gravity to extend the bolt of the latch mechanism from its retracted position to its extended position as the door of a front-loading commercial warewashing machine is moved from a horizontal opened position to a vertical position. In this way, the bolt of the latch mechanism is extended to abut the keeper of a warewashing machine if the door is simply moved from the opened horizontal position to the vertical position, but may be easily and quickly closed by manual operation of the latch mechanism to retract the bolt, completely close the door, and then once again extend the bolt to secure the door in the fully-closed position.

According to one aspect of the present invention, an improved latch mechanism comprises bolt means mounted to the door of a front-loading commercial warewashing machine for movement between an extended position and a retracted position, and bolt control means for moving the bolt means between the retracted and extended positions. The bolt control means defines a handle for manual movement of the bolt means and is also controlled by gravity to move the bolt means from its retracted position to its extended position as the door is moved from an opened horizontal position to a vertical position such that the bolt means of the latch mechanism is extended to prevent complete closure of the door unless the handle is manually operated to retract the bolt means. Preferably, the bolt means is mounted to support means which in turn is adapted to be mounted on the door, with the bolt means being mounted for linear movement relative to the support means.

The support means preferably comprises a housing having opposed sidewalls and defining a base mounting flange, with the housing being substantially open at its lower end and defining a slot opening adjacent and parallel to the base mounting flange at its upper end and having a pivot pin extending between the sidewalls. Bolt means extend through the slot opening and define an actuation channel within the housing, with the handle means being mounted to the pivot pin and further comprising an arm extending into the actuation channel of the bolt means. To facilitate manual operation of the latch mechanism, the handle or operating lever defines a downwardly-curved hand-receiving gripper portion.

For simplicity of construction of the improved latch mechanism of the present invention, the bolt means preferably comprises first and second planar members having outwardly-turned flanges extending beyond the housing and inwardly-turned flanges extending within the housing, with the second planar member being shorter than the first planar member and secured thereto such that the outwardly-turned flanges are adjacent to one another and the inwardly-turned flanges are separated from one another to define the actuation channel of the bolt means. Preferably, the inwardly-turned flange of the second planar member is oriented at an acute angle relative to the second planar member, and the arm of the handle means is rounded to smoothly engage the inwardly-turned flange of the second planar member.

The improved latch mechanism is particularly useful for a warewashing machine including a door switch which is activated by complete or full closure of the warewasher door to initiate a wash/rinse operating cycle. In such machines, the latch mechanism of the present application prevents inadvertent full closure of the door, and hence, unintended initiation of an energy and water consuming operating cycle of the warewashing machine. It is also noted that the bolt control means serves to retract the bolt when the door is moved from its vertical position to its horizontal position to reduce the extension of the bolt beyond the end of the door, and thereby lessen the possibility of snagging the bolt when the door is open.

It is, therefore, an object of the present invention to provide an improved latch mechanism for the door of a front-loading commercial warewashing machine wherein a bolt member is controlled by the force of gravity to move from a retracted position to an extended position upon movement of the warewasher door from an opened horizontal position to a vertical position, and once extended, to abuttingly engage a keeper and thereby prevent inadvertent complete closure of the door, said latch member also being manually operated by means of an operating lever or handle which permits convenient manual retraction of the bolt member to permit complete closure of the door which is then secured by extension of the bolt to a retaining position behind the keeper.

Other objects and advantages of the invention will be apparent from the following description, the accompanying drawings and the appended claims.

DETAILED DESCRIPTION OF THE INVENTION

The characteristics and operation of a front-loading commercial warewasher to which the improved latch mechanism of the present invention is particularly applicable are well known, and hence, will be described only briefly herein. Those desiring additional background information relating to warewashers should refer to the referenced U.S. patent application Ser. No. 833,946.

Figure 1:
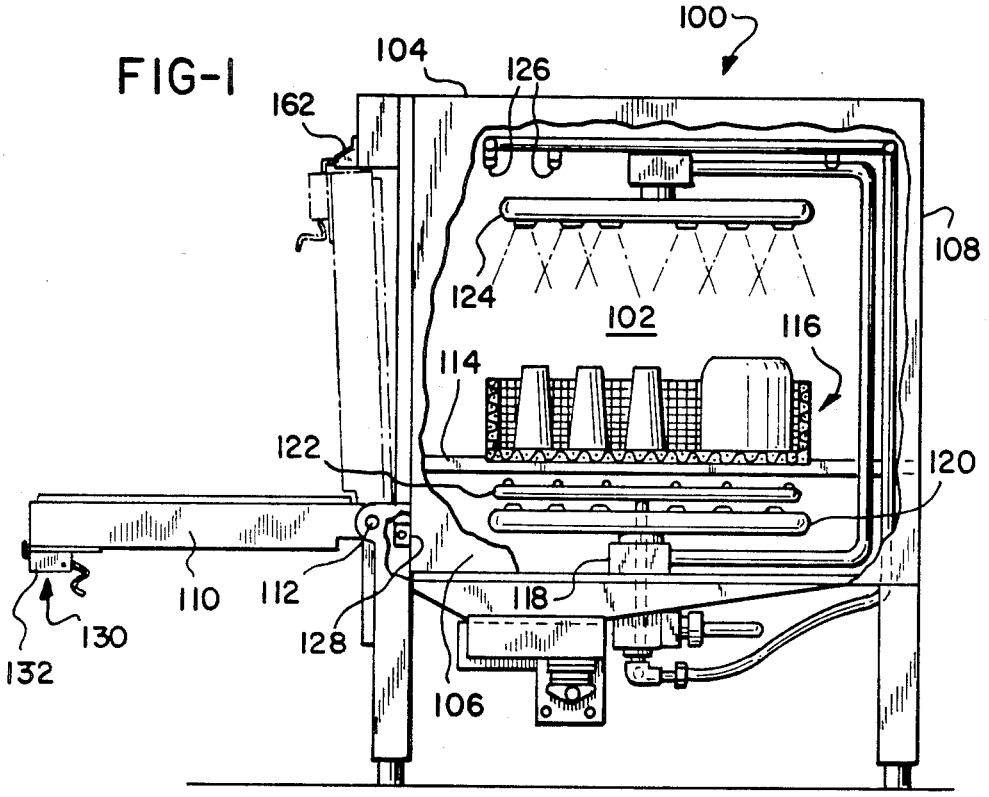
FIG. 1 is a side view of a front-loading commercial warewasher including the improved latch mechanism of the present invention.

Referring to FIG. 1, a front-loading commercial warewasher 100 includes a wash chamber or, more accurately, a washing/rinsing chamber 102 which is defined by a cabinet usually formed of stainless steel panels and components and including a top wall 104, sidewalls 106 and rear wall 108, and a front-facing door 110 hinged at its lower end to the cabinet as indicated at 112. The chamber 102 is vented to ambient pressure through labyrinth seals (not shown) formed entirely around the door 110.

Rails 114 within the chamber 102 provide support for standard ware racks 116 loaded with ware to be washed and sanitized, which are deposited and removed from the rails 114 through the opening adjacent the front door 110. A coaxial fitting 118 positioned centrally of the chamber 102 provides support for a lower wash arm 120 and lower rinse arm 122, each of conventional reaction type. An upper wash arm 124 and upper rinse spray heads 126 are supported from the top wall 104 of the chamber 102.

For simplicity of operation and to facilitate rapid washing for consecutive racks or loads of ware in the warewasher 100, a door switch 128 generates a signal when the door 110 is completely closed. The signal from the door switch 128 indicates that a rack of soiled ware has been inserted into the chamber 102 and that a machine wash/rinse operating cycle is to be initiated. Accordingly, for a series of racks to be consecutively washed after a first rack, all that is required to operate the warewasher 100 is that each washed rack of ware be removed from the warewasher 100, a soiled rack of ware be inserted into the chamber 102 and the door 110 be completely closed to operate the switch 128 thereby initiating a machine wash/rinse cycle.

As previously noted, initiation of a machine wash-/rinse cycle by means of the signal generated by the door switch 128 upon complete closure of the door 110 is advantageous to expedite operations during busy times; however, such operation can lead to wasted water and energy if the door is inadvertently fully closed while the wash chamber 102 is empty. Such inadvertent closure can be effected in a busy restaurant environment due to the desire to free-up the floor space occupied by the door 110 in its horizontal opened position as shown by the solid line drawing in FIG. 1. Thus, a restaurant worker may move the door from the opened horizontal position shown in solid lines in FIG. 1 to the vertical position shown in dotted lines in FIG. 1.

While such closure of the door 110 may be performed quite gently such that the door is not completely closed and the door switch 128 is therefore not activated to commence a wash/rinse cycle of the warewasher 100, it is more likely that such closure will be performed impatiently, rapidly and harshly possibly by means of kicking or otherwise roughly lifting the door 110. Unless otherwise protected, such rough closure is apt to fully close the door 110, activate the switch 128 and initiate a machine wash/rinse cycle whether or not a rack of soiled ware to be washed has been placed within the chamber 102. The latch mechanism 130 of the present invention prevents such inadvertent complete closure of the door 110 while permitting rapid and convenient intentional closure of the door to initiate an operating cycle of the warewasher 100.

Figure 3:
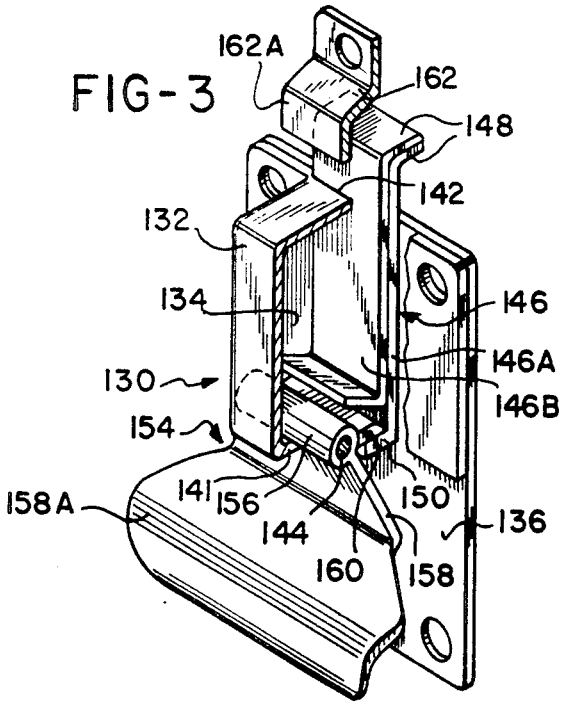
FIG. 3 is a perspective view of the latch mechanism of FIG. 2 with portions broken away to illustrate its internal structure.
Figure 2:
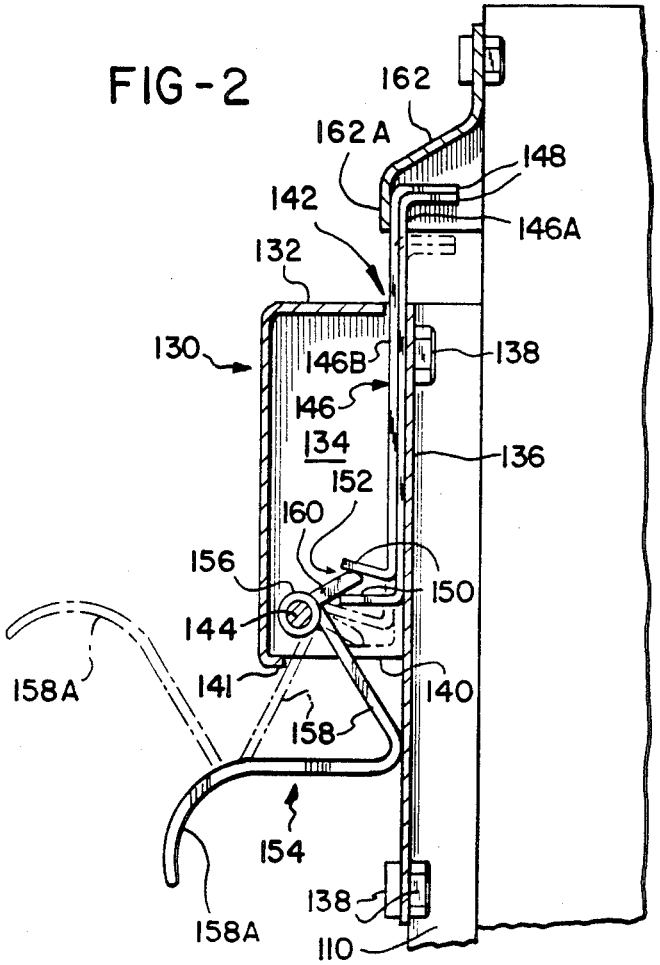
FIG. 2 is a partially sectioned side view of an illustrative embodiment of the improved latch mechanism of FIG. 1 on an enlarged scale.

The improved latch mechanism 130 as best shown in FIGS. 2 and 3 comprises support means adapted to be mounted to the door 110. In the illustrative embodiment, the support means comprises a housing 132 having opposed sidewalls 134 and a base mounting flange 136 which is secured to the door 110 by means of fasteners 138 or otherwise. The housing 132 is substantially open at its lower end 140 with the exception of a handle abutment tab 141, and defines a slot opening 142 adjacent and parallel to the base mounting flange 136 at its upper end. A pivot pin 144 is secured between the sidewalls 134. Bolt means 146 extends through the slot opening 142 and is captured within the housing 132 yet may be linearly moved in and out of said slot opening 142 between a retracted position and an extended position.

The bolt means 146 in the illustrative embodiment comprises a first planar member 146A and a second planar member 146B having outwardly-turned flanges 148 extending beyond the housing 132, and inwardly-turned flanges 150 extending within the housing 132. The second planar member 146B is shorter than the first planar member 146A and secured thereto, for example, by spot welding, such that the outwardly-turned flanges 148 are adjacent to one another and the inwardly-turned flanges 150 are separated from one another to define an actuation channel 152 for the bolt means 146.

Bolt control means or handle means 154 are provided for moving the bolt means 146 between its retracted position and its extended position. The handle means 154 comprises a barrel 156 mounted for pivotal movement around the pivot pin 144 which extends between the sidewalls 134. An angled operating lever or handle 158 is secured to the barrel 156 and extends out the open lower end 140 of the housing 132 and angles back upon itself outside the housing 132 at an acute angle to define a downwardly-curved hand-receiving gripper portion 158A. A bolt actuating lever arm 160 is also secured to the barrel 156 and extends into the actuation channel 152 of the bolt means 146.

As is apparent from a review of FIGS. 2 and 3, the bolt means 146 can be moved between its retracted and extended positions by means of the handle 158. In particular, if an operator of the warewasher grips the downwardly-curved hand-receiving gripper portion 158A of the handle 158 and raises it from the solid line to the dash-dot line position, as shown in FIG. 2, the bolt means 146 is moved from its extended position to its retracted position such that the door 110 can be fully closed against the warewasher 100. Once the door 110 is fully closed, the handle 158 may be returned to its solid line position to once again extend the bolt means 146 behind a keeper 162 to maintain the door 110 in its fully-closed position for an operating cycle of the warewasher 100.

It is noted that, in the preferred embodiment of the present invention, the inwardly-turned flange 150 of the second planar member 146B is oriented at an acute angle relative to the second planer member 146B and the bolt actuating lever arm 160 is rounded to smoothly engage the acute-angled inwardly-turned flange 150 of the second planar member 146B. Such formation facilitates smooth operation of the latch mechanism 130 of the present invention.

The barrel 156, and hence, the pivot point of the bolt control or handle means 154 is remote from the door 110. The handle means 154 is also of sufficient mass, which is distributed outside the pivot point of the handle means 154, such that the latch mechanism 130 of the present invention is also controlled by gravity to move the bolt means 146 between its retracted and extended positions as the door is moved. For example, the bolt means 146 is moved from its retracted position to its extended position as the door 110 is moved from its horizontal opened position to its vertical position such that the latch mechanism prevents complete closure of the door 110 unless the handle 158 is manually operated to retract the bolt means 146.

Figure 6:
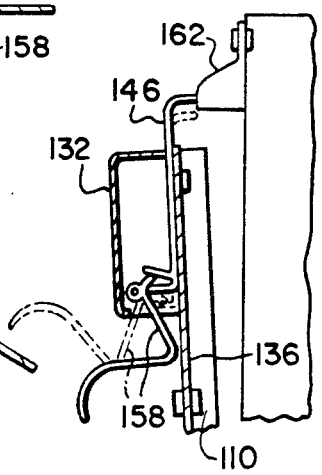

As best shown in FIGS. 1 and 6, when the bolt means 146 is moved to its extended position (either manually or by the force of gravity as the door is moved toward its vertical position), the outwardly-turned flanges 148 of the bolt means 146 engage the front surface 162A of the keeper 162 such that the door 110 is prevented from being completely closed and thereby activating the door switch 128 to initiate a warewasher operating cycle.

Figure 4:
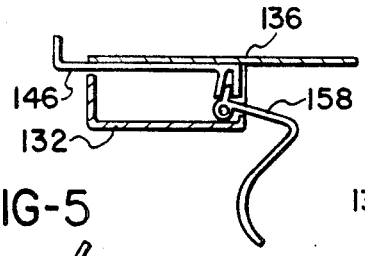
FIGS. 4–7 are a sequence of partially sectioned side views of the latch mechanism of FIGS. 2 and 3 showing operation of the latch mechanism initially under the force of gravity to prevent inadvertent complete closure of the warewasher door, and finally, manual operation to retract the bolt, close the door and extend the bolt to secure the door in its closed position.
Figure 5:
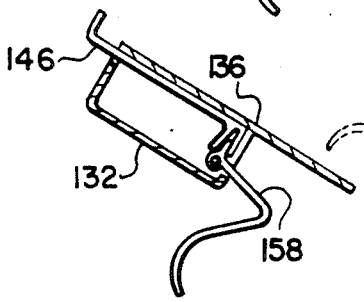
Figure 7:
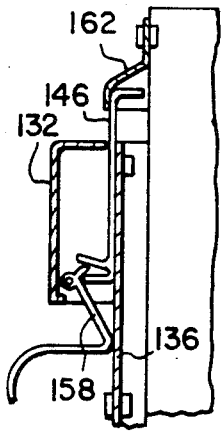

It is thus apparent that if the door 110 is moved from its horizontal opened position to its vertical position the door 110 will not be completely closed due to the abutting engagement of the latch means 146 with the keeper 162 unless the handle 158 is manually operated to retract the bolt means 146. This is due to the automatic extension of the bolt means 146 under the influence of the force of gravity as the door 110 is moved from its horizontal opened position to its vertical position. The sequential extension of the bolt means 146 and the resulting abutting engagement of the bolt means 146 with the keeper 162 is shown sequentially in FIGS. 4–6. However, for easy intentional closure, the handle 158 is manually controlled to retract the bolt means 146, completely close the door 110, and then extend the bolt means 146 as shown sequentially by FIGS. 6 and 7.

The bolt means 146 is also moved by the force of gravity to its retracted position when the door 110 is moved to its horizontal opened position such that the bolt is unobtrusively positioned closely adjacent to the door 110, and therefore, is less likely to snag the apparel of a person passing by the washing machine when the door 110 is in its opened position. Such movement of the bolt means 146 can be seen by reviewing FIGS. 4–6 in reverse order.

While the form of apparatus herein described constitutes a preferred embodiment of this invention it is to be understood that the invention is not limited to this precise form of apparatus and that changes may be made therein without departing from the scope of the invention which is defined in the appended claims.

What is claimed is:

1. An improved latch mechanism for a front-loading commercial warewashing machine having a wash chamber and a door operable between a horizontal opened position and a vertical position adjacent to said wash chamber, said latch mechanism engaging a keeper mounted to said chamber when said door is in said vertical position and comprising:

bolt means mounted to said door for movement between an extended position and a retracted position; and bolt control means for moving said bolt means between said retracted and extended positions, said bolt control means defining a handle for manual movement of said bolt means and being controlled by gravity to move said bolt means from said retracted position to said extended position as said door is moved from said horizontal opened position to said vertical position whereby said latch mechanism prevents complete closure of said door unless said handle is manually operated to retract said bolt means.

2. An improved latch mechanism for a commercial warewashing machine as claimed in claim 1 wherein said warewashing machine includes a door switch which is actuated by complete closure of said door to initiate a wash/rinse operating cycle of said warewashing machine whereby said latch mechanism prevents inadvertent actuation of said door switch, and hence, unintended initiation of an operating cycle of said warewashing machine.

3. An improved latch mechanism for a commercial warewashing machine as claimed in claim 2 wherein said bolt control means is further controlled by gravity to move said bolt means from said extended position to said retracted position as said door is moved from said vertical position to said horizontal opened position whereby the extension of said bolt means is reduced when said door is in said horizontal opened position to lessen the possibility of snagging said bolt means.

4. In a front-loading commercial warewashing machine having a wash chamber, a door pivotally operable between a horizontal opened position and a vertical position adjacent to said wash chamber, and a keeper mounted to said chamber above said door when said door is in said vertical position, an improved latch mechanism for operation with said keeper to ensure said door is fully closed only when intended, and comprising:

a bolt member mounted to said door for linear movement relative thereto between an extended position and a retracted position; and bolt control means for moving said bolt member between said retracted position and said extended position, said bolt control means comprising a handle portion for manual movement of said bolt member such that said bolt member can be retracted for full closure of said door and extended to secure said door in said fully-closed position, said bolt control means also being controlled by gravity to move said bolt member to said extended position as said door is moved from said horizontal position to said vertical position whereby said latch mechanism prevents inadvertent closure of said door due to abutting contact of said bolt member with said keeper unless said handle portion is manually operated to move said bolt member to said retracted position, thereby permitting intentional full closure of said door.

5. An improved latch mechanism for a commercial warewashing machine as claimed in claim 4 wherein said warewashing machine includes a door switch which is actuated by complete closure of said door to initiate a wash/rinse operating cycle of said warewashing machine whereby said latch mechanism prevents inadvertent actuation of said door switch, and hence, unintended initiation of an operating cycle of said warewashing machine.

6. An improved latch mechanism for a commercial warewashing machine as claimed in claim 5 wherein said bolt control means is further controlled by gravity to move said bolt member from said extended position to said retracted position as said door is moved from said vertical position to said horizontal position whereby the extension of said bolt member is reduced when said door is in said horizontal position to lessen the possibility of snagging said bolt member.

7. In a commercial warewashing machine having a wash chamber defining a front opening, a door pivotally mounted to said chamber adjacent the lower edge of said opening and movable between a horizontal opened position and a vertical position across said opening, and a keeper on said chamber at the upper edge of said opening, an improved latch mechanism operable with said keeper to prevent the inadvertent complete closure of said door and comprising:

support means adapted to be mounted on said door;

bolt means mounted to said support means for linear movement relative thereto between a retracted position and an extended position; and handle means mounted to said support means for moving said bolt means between said retracted position and said extended position, said handle means defining an operating lever extending from said support means and being mounted for pivotal movement toward and away from said support means for extending and retracting manually said bolt means, respectively, said operating lever being acted upon by gravity to move said bolt means from said retracted position to said extended position as said door is moved from said horizontal opened position to said vertical position whereby said bolt means abuttingly engages said keeper to prevent complete closure of said door unless said operating lever is pivoted away from said support means to retract said bolt means and thereby permit intentional complete closure of said door which is secured by pivoting said operating lever toward said support means to extend said bolt means and engage it behind said keeper.

8. An improved latch mechanism for a commercial warewashing machine as claimed in claim 7 wherein said support means comprises a housing having opposed sidewalls and expanding into a base mounting flange, said housing being substantially open at its lower end and defining a slot opening adjacent and parallel to said base mounting flange at its upper end and including a pivot pin extending between said sidewalls, said bolt means extending through said slot opening and defining an actuation channel within said housing, said handle means being mounted to said pivot pin and further comprising an arm extending into said actuation channel of said bolt means.

9. An improved latch mechanism for a commercial warewashing machine as claimed in claim 8 wherein said operating lever defines a downwardly-curved hand-receiving gripper portion.

10. An improved latch mechanism for a commercial warewashing machine as claimed in claim 8 wherein said bolt means comprises first and second planar members having outwardly-turned flanges extending beyond said housing and inwardly-turned flanges extending within said housing, said second planar member being shorter than said first planar member and secured thereto such that said outwardly-turned flanges are adjacent to one another and said inwardly-turned flanges are separated from one another to define said actuation channel of said bolt means.

11. An improved latch mechanism for a commercial warewashing machine as claimed in claim 10 wherein the inwardly-turned flange of said second planar member is oriented at an acute angle relative to said second planar member, and said arm is rounded to smoothly engage the acute-angled inwardly-turned flange of said second planar member.

12. An improved latch mechanism for a commercial warewashing machine as claimed in claim 11 wherein said warewashing machine includes a door switch which is actuated by complete closure of said door to initiate a wash/rinse operating cycle of said warewashing machine whereby said latch mechanism prevents inadvertent actuation of said door switch, and hence, unintended initiation of an operating cycle of said warewashing machine.

13. An improved latch mechanism for a commercial warewashing machine as claimed in claim 12 wherein said operating lever is further acted upon by gravity to move said bolt means from said extended position to said retracted position as said door is moved from said vertical position to said horizontal opened position whereby the extension of said bolt means is reduced when said door is in said horizontal opened position to lessen the possibility of snagging said bolt means.

14. In a commercial warewashing machine having a wash chamber defining a front opening, a door pivotally mounted to said chamber adjacent the lower edge of said opening and movable between a horizontal opened position and a vertical position across said opening, and a keeper on said chamber at the upper edge of said opening, an improved latch mechanism operable with said keeper to prevent the inadvertent complete closure of said door and comprising:

support means adapted to be mounted on said door;

bolt means mounted to said support means for linear movement relative thereto between a retracted position and an extended position; and handle means mounted to said support means for moving said bolt means between said retracted position and said extended position, said handle means defining an operating lever extending from said support means and being mounted for pivotal movement toward and away from said support means for extending and retracting manually said bolt means, respectively, the pivotal mounting of said operating lever being remote from said door, and said operating lever being of sufficient mass, which is distributed outside the pivotal mounting, such that said operating lever is acted upon by gravity to move said bolt means between said retracted position and said extended position as said door is moved between said horizontal opened position and said vertical position.

* * * * *